US009065194B2

(12) United States Patent
Suzuki et al.

(10) Patent No.: US 9,065,194 B2
(45) Date of Patent: Jun. 23, 2015

(54) CONNECTOR

(75) Inventors: Toru Suzuki, Shizuoka (JP); Hajime Kato, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 13/983,526

(22) PCT Filed: May 21, 2012

(86) PCT No.: PCT/JP2012/062964
§ 371 (c)(1),
(2), (4) Date: Aug. 2, 2013

(87) PCT Pub. No.: WO2012/157779
PCT Pub. Date: Nov. 22, 2012

(65) Prior Publication Data
US 2014/0057480 A1 Feb. 27, 2014

(30) Foreign Application Priority Data
May 19, 2011 (JP) ..... 2011-112285

(51) Int. Cl.
*H01R 13/621* (2006.01)
*H01R 11/12* (2006.01)
*H01R 4/34* (2006.01)
*H01R 13/405* (2006.01)

(52) U.S. Cl.
CPC ..... *H01R 11/12* (2013.01); *H01R 4/34* (2013.01); *H01R 13/405* (2013.01); *H01R 13/621* (2013.01); *H01R 2201/26* (2013.01)

(58) Field of Classification Search
CPC ..... H01R 11/12
USPC ..... 439/359, 606
See application file for complete search history.

(56) References Cited

U.S. PATENT DOCUMENTS 7,165,995 B2 1/2007 Fukushima et al.
8,342,880 B2 * 1/2013 Kato et al. ..... 439/595
8,545,265 B2 * 10/2013 Sakamoto et al. ..... 439/606
(Continued)

FOREIGN PATENT DOCUMENTS

JP 2007-258105 A 10/2007
JP 2008-258070 A 10/2008
(Continued)

OTHER PUBLICATIONS

International Search Report and Written Opinion of the International Search Report for PCT/JP2012/062964 dated Jul. 24, 2012.
(Continued)

*Primary Examiner* — James Harvey
(74) *Attorney, Agent, or Firm* — Kenealy Vaidya LLP

(57) ABSTRACT

A connector can prevent, at a low cost, a phenomenon that a crack develops in a resin molded member to which a screwing plate portion of a terminal fitting is fixed due to a bending displacement of the screwing plate portion caused by fastening force of the screwing when the screwing plate portion is screwed to a terminal stage. A plate portion fixing portion 31, to which a screwing plate portion 11 of a terminal fitting 10 is fixed, of the connector housing 30 has a terminal escape space 31*a* adjacent to the screwing plate portion 11 on a destination side in a direction of fastening to a terminal stage 40. The terminal escape space 31*a* permits a bending displacement of the screwing plate portion 11 in the fastening direction.

9 Claims, 4 Drawing Sheets

(56) References Cited

U.S. PATENT DOCUMENTS

| | | | | |
|---|---|---|---|---|
| 8,641,444 | B2 * | 2/2014 | Yoshida et al. | 439/487 |
| 2004/0266269 | A1 | 12/2004 | Miyazaki | |
| 2010/0261365 | A1 | 10/2010 | Sakakura | |
| 2011/0014822 | A1 * | 1/2011 | Kato et al. | 439/733.1 |
| 2012/0058660 | A1 * | 3/2012 | Aoki et al. | 439/272 |
| 2014/0024239 | A1 * | 1/2014 | Tanaka et al. | 439/271 |
| 2014/0057480 | A1 * | 2/2014 | Suzuki et al. | 439/359 |

FOREIGN PATENT DOCUMENTS

| | | | |
|---|---|---|---|
| JP | 2009-211976 | A | 9/2009 |
| WO | 2009/110639 | A2 | 9/2009 |

OTHER PUBLICATIONS

International Preliminary Report on Patentability for PCT Patent App. No. PCT/JP2012/062964 (Nov. 28, 2013).

Japanese Office Action for the related Japanese Patent Application No. 2011-112285 dated Jan. 6, 2015.

The extended European Search Report for the related European Patent Application No. 12785262.2 dated Sep. 25, 2014.

Chinese Office Action for the related Chinese Patent Application No. 201280011133.8 dated Mar. 16, 2015.

* cited by examiner

CONNECTOR

TECHNICAL FIELD

The present invention relates to a connector in which a terminal fitting to be screwed to a terminal stage is fixed to a connector housing which is molded integrally with the terminal fitting.

BACKGROUND ART

FIG. 4 shows a conventional connector in which a terminal fitting to be screwed to a terminal stage is fixed to a connector housing.

The connector 100 shown in FIG. 4, which is disclosed in the following Patent document 1, is equipped with a metal fitting 110, a resin connector housing 120, and a resin molded member 130.

The metal fitting 110 is a member formed by pressing a metal plate and has a screwing plate portion 111 at one end and a wire connection portion 112 at the other end.

The screwing plate portion 111 is a flat-plate-like portion to be screwed to a mating terminal stage 210. A screw insertion hole 111*a* through which a male screw portion 411 of a bolt 410 is to be inserted is formed through the screwing plate portion 111. The terminal stage 210 is a metal stage to which the screwing plate portion 111 is to be connected conductively. The terminal stage 210 is provided with a female screw portion 211 to be threadedly engaged with the male screw portion 411 of the bolt 410.

The screwing plate portion 111 is fastened to the terminal stage 210 with the bolt 410 and thereby connected to the terminal stage 210 electrically and mechanically.

The wire connection portion 112 is a portion to which a conductor 311 of an electric wire 310 is connected by crimping.

The connector housing 120 has a terminal housing hole 121 which houses the metal fitting 110. A shield shell 140 for electromagnetically shielding the connector housing 120 from the outside by surrounding it is provided around the connector housing 120.

The electric wire 310 which is connected to the metal fitting 110 is provided with a tube-like shield net 150 for electromagnetically shielding the electric wire 310 from the outside by surrounding it.

An end portion, on the side of the shield shell 140, of the shield net 150 is fitted with the outer surface of an end cylindrical portion 141 of the shield shell 140 and fixed to the cylindrical portion 141 by a shield ring 160 which is fitted with the cylindrical portion 141 from outside the shield net 150.

The space around the metal fitting 110 in the terminal housing hole 121 of the connector housing 120 is filled with the resin molded member 130, whereby the metal fitting 110 is fixed to the connector housing 120.

As shown in FIG. 4, when the screwing plate portion 111 which is fixed to the connector housing 120 by the resin molded member 130 is positioned with respect to the terminal stage 210, the connector housing 120 itself is positioned being fitted into a cylindrical portion 511 of a device-side shield shell 510.

PRIOR ART DOCUMENTS

Patent Documents

Patent document 1: JP-A-2008-258070

SUMMARY OF THE INVENTION

Problems to be Solved by the Invention

Incidentally, in the connector 100 disclosed in Patent document 1, in a state that the connector housing 120 is positioned by the cylindrical portion 511 of the device-side shield shell 510, in general a gap S1 is formed between the screwing plate portion 111 and the terminal stage 210.

Therefore, when the screwing plate portion 111 is fastened to the terminal stage 210 with the bolt 410, a bending displacement occurs in the screwing plate portion 111 in the fastening direction (indicated by arrow Y1 in FIG. 4). The bending displacement of the screwing plate portion 111 causes bending stress or shearing stress in the resin molded member 130 and the connector housing 120 which are in contact with each other in the bending direction of the screwing plate portion 111.

If the gap S1 between the screwing plate portion 111 and the terminal stage 210 is large and hence the bending displacement occurring in the screwing plate portion 111 at the time of fastening is large, the resin molded member 130 and the connector housing 120 receive so high stress that a crack may develop in the resin molded member 130 or the connector housing 120.

One measure for preventing the above problem would be to increase the dimensional accuracy levels of the components of the connector 100 so that the gap S1 between the screwing plate portion 111 and the terminal stage 210 becomes small. However, the increase of the dimensional accuracy levels of the components of the connector 100 leads to another problem such as increase in the manufacturing costs of the components.

An object of the present invention, which relates to solving of the above problem, is to provide a connector which can prevent, at a low cost, a phenomenon that a crack develops in a resin molded member to which a screwing plate portion of a terminal fitting is fixed due to a bending displacement of the screwing plate portion that is caused by fastening force of the screwing when the screwing plate portion is screwed to a terminal stage.

Means for Solving the Problems

The above-mentioned object of the invention is attained by the following configurations:

(1) A connector comprising:

a terminal fitting that includes, at one end, a screwing plate portion to be screwed to a mating terminal stage and includes, at the other end, a wire connection portion to which an electric wire is connected;

a connector housing configured by a resin molded member which is molded integrally with the terminal fitting and the electric wire; and a shield shell disposed outside the connector housing, wherein a plate portion fixing portion, to which an outer surface of the screwing plate portion is fixed, of the connector housing is formed with a terminal escape space which is positioned adjacent to the screwing plate portion on a destination side in a direction of fastening from the screwing plate portion to the terminal stage, the terminal escape space permitting a bending displacement of the screwing plate portion in the fastening direction.

(2) The connector according to item (1), wherein an outer circumferential surface of the connector housing is provided with a ring-shaped waterproof member.

In the configuration of item (1), when the screwing plate portion is fastened to the mating terminal stage with a bolt, a bending displacement occurs in the screwing plate portion in the fastening direction. However, the plate portion fixing portion, to which an outer surface of the screwing plate portion is fixed, of the connector housing is formed with the terminal escape space adjacent to the screwing plate portion on the destination side in the direction of its fastening to the terminal stage. The terminal escape space permits a bending displacement of the screwing plate portion in the fastening direction.

Therefore, even when a bending displacement occurs in the screwing plate portion in the fastening direction, the screwing plate portion exerts no bending stress or shearing stress in the fastening direction on the plate portion fixing portion of the connector housing.

Therefore, when the screwing plate portion of the terminal fitting is screwed to the terminal stage, a phenomenon can be prevented that a crack develops in the connector housing due to a bending displacement of the screwing plate portion that is caused by fastening force of the screwing.

Furthermore, since the plate portion fixing portion of the connector housing is formed with the terminal escape space for permitting bending displacement of the screwing plate portion, it is not necessary to reduce the gap between the screwing plate portions and the terminal stage which causes occurrence of a bending displacement. In other words, it is not necessary to increase the accuracy of the components which leads to cost increase, to reduce the gap between the screwing plate portion and the terminal stage.

Therefore, a phenomenon that a crack develops in the connector housing to which the screwing plate portion is fixed can be prevented at a low cost.

According to the configuration of item (2), the waterproofness is not impaired even if the connector housing is fixed in an inclined manner at the time of fastening with a bolt.

MODE FOR CARRYING OUT THE INVENTION

A connector according to an embodiment of the present invention will be hereinafter described in detail with reference to the drawings.

Figure 1:
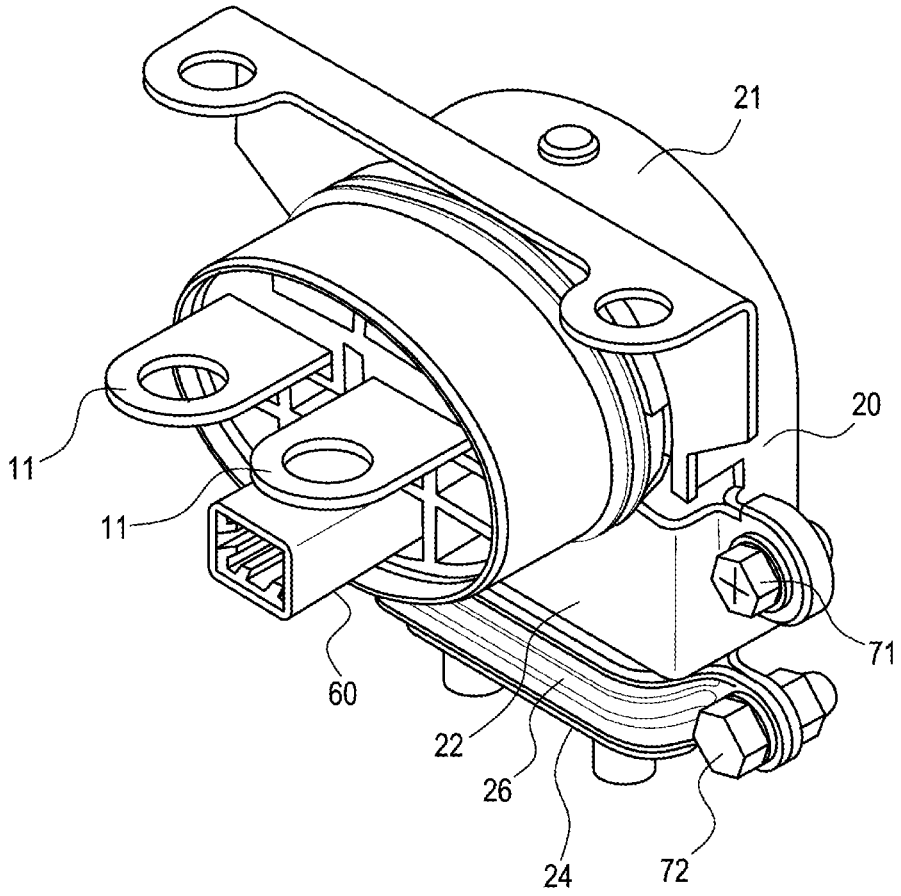
FIG. 1 is a perspective view of a connector according to an embodiment of the present invention.
Figure 2:
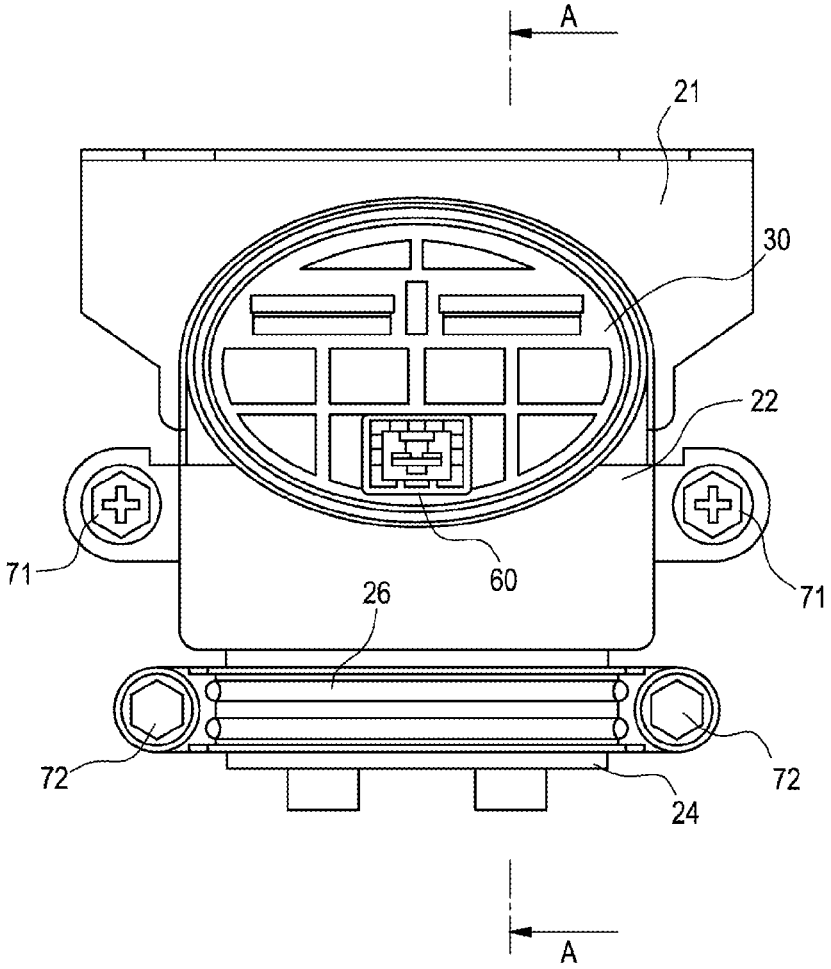
FIG. 2 is a front view of the connector shown in FIG. 1.
Figure 3:
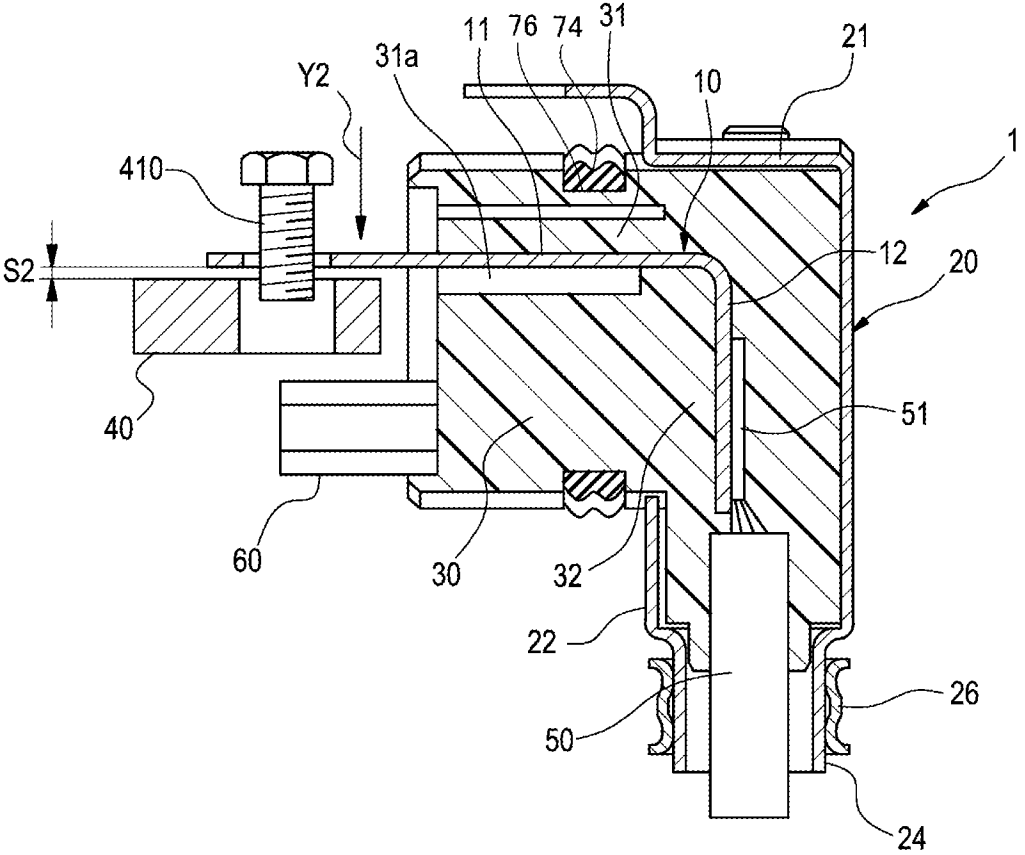
FIG. 3 is a sectional view taken along line A-A in FIG. 2.
Figure 4:
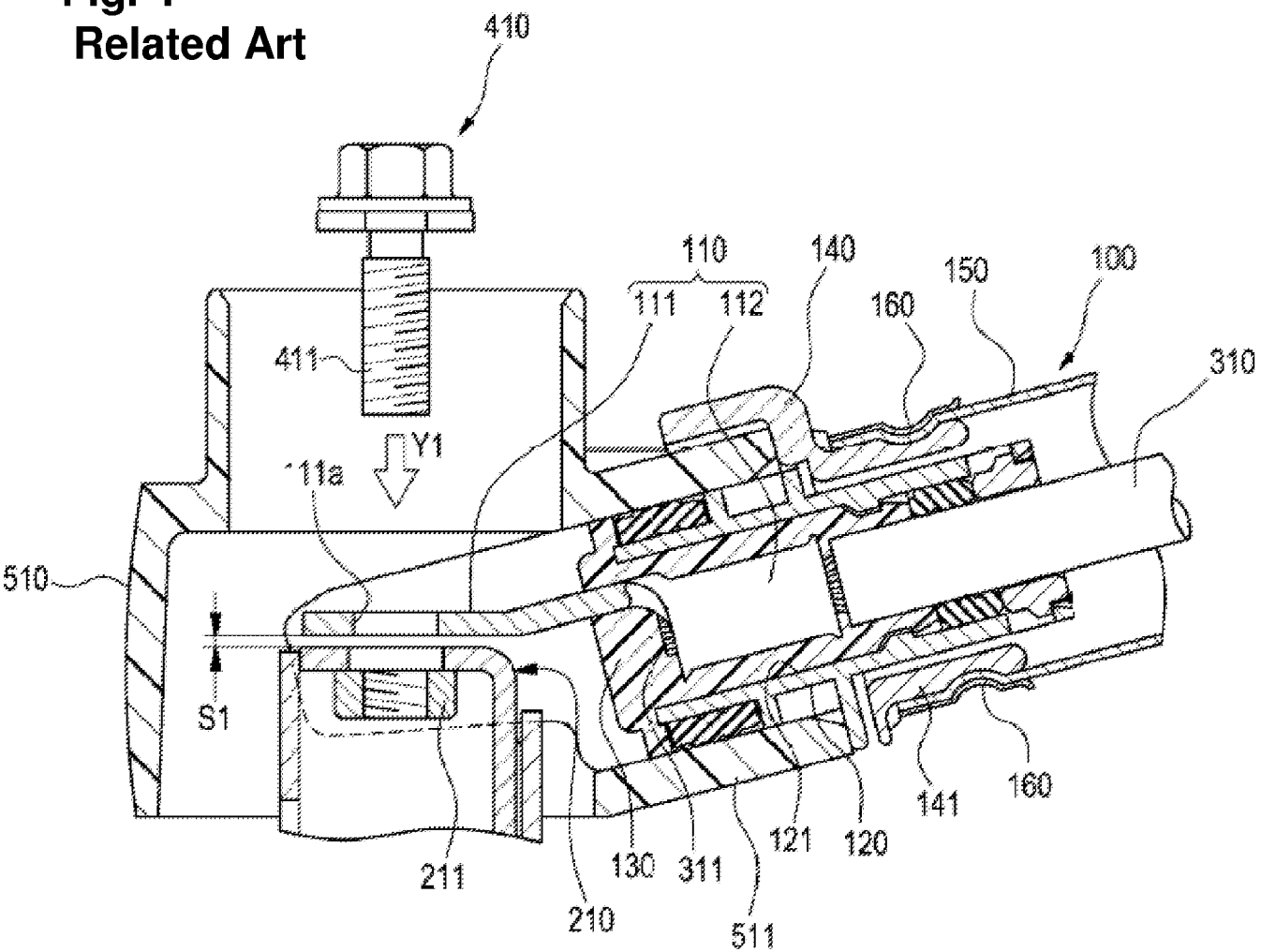
Fig. 4 Related Art
FIG. 4 is a vertical sectional view showing the structure of a conventional connector.

FIGS. 1-3 show the connector according to the embodiment of the invention. FIG. 1 is a perspective view of the connector according to the embodiment of the invention. FIG. 2 is a front view of the connector shown in FIG. 1. FIG. 3 is a sectional view taken along line A-A in FIG. 2.

The connector 1 according to the embodiment is equipped with plural (in this embodiment, two) terminal fittings 10, a connector housing 30 (resin molded member) to which the terminal fittings 10 are fixed, and a metal shield shell 20 (21, 22) which is disposed outside the connector housing.

Each terminal fitting 10 which is a member formed by pressing a metal plate has a screwing plate portion 11 at one end and a wire connection portion 12 at the other end.

The screwing plate portion 11 is a flat-plate-like portion to be screwed to a mating terminal stage 40. The screwing plate portion 11 is fastened to the terminal stage 40 with a bolt 410. The terminal stage 40 is a metal stage to which the screwing plate portion 11 is to be connected conductively. The screwing plate portion 11 is fastened to the terminal stage 40 with the bolt 410 and thereby connected to the terminal stage 40 electrically and mechanically.

The wire connection portion 12 is a portion to which a conductor 51 of an electric wire 50 is connected conductively.

Although not shown in any drawing, a portion, located outside the connector housing 30, of the electric wire 50 is covered with a tube-like shield net (not shown) to shield the electric wire 50 electromagnetically from the outside.

The shield shell 20 has a first shell 21 which constitutes a rear outer wall and a second shell 22 which constitutes a front outer wall. The first shell 21 and the second shell 22 combined together when fastened with bolts 71, and thereby define a space in which the connector housing 30 is housed.

The shield shell 20, which is formed by combining the first shell 21 and the second shell 22 together, has a cylindrical portion 24 in which the electric wires 50 connected to the terminal fittings 10 are inserted. The cylindrical portion 24 is covered with end portions of the shield nets with which the electric wires 50 are covered. The end portions of the shield nets with which the cylindrical portion 24 is covered are fixed to the outer circumferential surface of the cylindrical portion 24 by a shield ring 26 which is attached to the outer circumferential surface of the cylindrical portion 24.

In the shield ring 26, a ring structure for fastening the outer circumferential surface of the cylindrical portion 24 is formed by combining two divisional halves together with bolts 72.

The connector housing 30 is an insulative resin molded member which fixes the terminal fittings 10 and the electric wires 50 when molded integrally with the terminal fittings 10 and the electric wires 50.

In the embodiment, the connector housing 30 has a plate portion fixing portion 31 with which a space around the screwing plate portions 11 are filled to fix proximal outer surfaces of the screwing plate portions 11 and a wire-side fixing portion 32 with which a space around the wire connection portions 12 are filled to fix the wire connection portions 12 and end portions of the electric wires 50.

The outer circumferential surface of the plate portion fixing portion 31 is formed with a groove 74 to which a waterproof member 76 (ring-shaped packing) is attached. When the connector housing 30 is fitted into a connector-40-side connector fitting portion, the waterproof member 76 comes into pressure contact with the connector fitting portion in a liquid-tight manner, whereby waterproofness is assured.

Therefore, waterproofness is not impaired even if the connector housing 30 is fixed in an inclined manner at the time of fastening with the bolts 410.

In the embodiment, the plate portion fixing portion 31 of the connector housing 30 is formed with terminal escape spaces 31*a* adjacent to the respective screwing plate portions 11 on the destination side in the direction of their fastening to the terminal stages 40 (i.e., in the direction indicated by arrow Y2 in FIG. 3). Each terminal escape space 31*a* is a space for permitting a bending displacement of the screwing plate portion 11 in the fastening direction.

Furthermore, in the embodiment, a housing connection portion 60 is provided. When as shown in FIG. 3 the screwing plate portions 11 are positioned with respect to the terminal stages, the housing connection portion 60 is fitted with a lock fitting portion (not shown) which is provided on the side of the terminal stages 40 and thereby prevents the connector housing 30 from coming off.

In the above-described connector 1 according to the embodiment, when the screwing plate portions 11 are fastened to the mating terminal stages 40 with the bolts 410, a bending displacement occurs in each screwing plate portion 11 in the fastening direction by an amount corresponding to a gap S2 (see FIG. 3) between the screwing plate portion 11 and the terminal stage 40. However, the plate portion fixing portion 31, to which outer surfaces of the screwing plate portions 11 are fixed, of the connector housing 30 is formed with the terminal escape spaces 31*a* adjacent to the respective screwing plate portions 11 on the destination side in the direction of their fastening to the terminal stages 40. Each terminal escape space 31*a* permits a bending displacement of the screwing plate portion 11 in the fastening direction.

Therefore, even when a bending displacement occurs in each screwing plate portion 11 in the fastening direction, the screwing plate portion 11 exerts no bending stress or shearing stress in the fastening direction on the plate portion fixing portion 31 of the connector housing 30.

Therefore, when the screwing plate portions 11 of the terminal fittings 10 are screwed to the terminal stages 40, a phenomenon can be prevented that a crack develops in the connector housing 20 due to a bending displacement of a screwing plate portion 11 that is caused by fastening force of the screwing.

Furthermore, since in the embodiment the plate portion fixing portion 31 of the connector housing 30 is formed with the terminal escape spaces 31*a* for permitting bending displacements of the screwing plate portions 11, it is not necessary to reduce the gaps S2 between the screwing plate portions 11 and the terminal stages 40 which cause occurrence of bending displacements. In other words, it is not necessary to increase the accuracy of the components which leads to cost increase, to reduce the gaps S2 between the screwing plate portions 11 and the terminal stages 40.

Therefore, development of a crack in the connector housing 30 to which the screwing plate portions 11 are fixed can be prevented at a low cost.

In the above-described connector 1 according to the embodiment, when the screwing plate portions 11 of the terminal fittings 10 are screwed to the mating terminal stages 40, a bending displacement of each screwing plate portion 11 that is caused by fastening force of the screwing is within the terminal escape space 31*a* and hence no load is exerted on the housing connection portion 60 due to bending displacements of the screwing plate portions 11.

Therefore, it is not necessary to increase the strength of the housing connection portion 60 to endure a load that is caused by bending displacements of the screwing plate portions 11. Thus, the housing connection portion 60 can be reduced in size and weight.

The connector according to the invention is not limited to the above-described one according to the embodiment, and modifications, improvements, etc. can be made as appropriate.

For example, the housing connection portion which is fitted with the terminal-stage-side lock fitting portion (not shown) and thereby prevents the connector housing from coming off need not always be provided in the resin molded member, and may be formed integrally with the connector housing.

The invention is not limited the above embodiment, and modifications, improvements, etc. can be made as appropriate. And the material, shape, dimensions, numerical values, form, number, location, etc. of each constituent element (or each set of constituent elements) of the embodiment are arbitrary and are not restricted as long as the invention can be implemented.

Although the invention has been described in detail by referring to the particular embodiment, it is apparent to those skilled in the art that various changes and modifications are possible without departing from the spirit and scope of the invention.

The present application is based on Japanese Patent Application No. 2011-112285 filed on May 19, 2011, the disclosure of which is incorporated herein by reference.

The features of the above-described connector according to the embodiment of the invention are summarized below in a simplified manner as items [1] and [2]:

[1] A connector (1) comprising:

a terminal fitting (10) that includes, at one end, a screwing plate portion (11) to be screwed to a mating terminal stage (40) and includes, at the other end, a wire connection portion (12) to which an electric wire (50) is connected;

a connector housing (30) configured by a resin molded member which is molded integrally with the terminal fitting (10) and the electric wire (50); and a shield shell (20) disposed outside the connector housing (30), wherein a plate portion fixing portion (31), to which an outer surface of the screwing plate portion (11) is fixed, of the connector housing (30) is formed with a terminal escape space (31*a*) which is positioned adjacent to the screwing plate portion (11) on a destination side in a direction of fastening from the screwing plate portion to the terminal stage (40), the terminal escape space (31*a*) permitting a bending displacement of the screwing plate portion (11) in the fastening direction.

The connector according to the above [1], wherein an outer circumferential surface of the connector housing (30) is provided with a ring-shaped waterproof member (76).

Industrial Applicability

In the connector according to the embodiment, when the screwing plate portions are fastened to the mating terminal stages with bolts, a bending displacement occurs in each screwing plate portion in the fastening direction. However, the plate portion fixing portion, to which outer surfaces of the screwing plate portions are fixed, of the connector housing is formed with the terminal escape spaces adjacent to the respective screwing plate portions on the destination side in the direction of their fastening to the terminal stages. Each terminal escape space permits a bending displacement of the screwing plate portion in the fastening direction.

Therefore, even when a bending displacement occurs in each screwing plate portion in the fastening direction, the screwing plate portion is allowed to be bent and displaced in the terminal escape space and hence exerts no bending stress or shearing stress in the fastening direction on the plate portion fixing portion of the connector housing.

Furthermore, it is not necessary to reduce the gaps between the screwing plate portions and the terminal stages which cause occurrence of bending displacements of the screwing plate portions by increasing the accuracy of the components.

Therefore, a phenomenon that a crack develops in the connector housing due to bending displacements of the screwing plate portions that are caused by fastening force of screwing can be prevented at a low cost.

DESCRIPTION OF SYMBOLS

1: Connector
10: Terminal fitting
11: Screwing plate portion
12: Wire connection portion

20 (21, 22): Shield shell
30: Connector housing
31: Plate portion fixing portion
31*a*: Terminal escape space
40: Terminal stage
60: Housing connection portion

The invention claimed is:

1. A connector comprising:

a terminal fitting that includes, at one end, a screwing plate portion to be screwed to a mating terminal stage and includes, at the other end, a wire connection portion to which an electric wire is connected;

a connector housing configured by a resin molded member which is molded integrally with the terminal fitting and the electric wire such that a cantilevered section of the screwing plate portion extends beyond the housing, the connector housing defining a front face from which the cantilevered section extends; and a shield shell disposed outside the connector housing, wherein a plate portion fixing portion, to which an outer surface of the screwing plate portion is fixed, of the connector housing is formed with a terminal escape space which is positioned adjacent to the screwing plate portion on a destination side in a direction of fastening from the screwing plate portion to the terminal stage, the terminal escape space being defined only part of a distance separating the front face of the connector housing and the wire connection portion thereby permitting a bending displacement of the screwing plate portion in the fastening direction.

2. The connector according to claim 1, wherein an outer circumferential surface of the connector housing is provided with a ring-shaped waterproof member.

3. The connector according to claim 1, wherein the terminal escape space is elongated and defines a single rectangular opening in cross-section.

4. The connector according to claim 1, wherein the screwing plate portion and the wire connection portion are each elongated, and are orthogonal relative to each other in their respective directions of elongation.

5. The connector according to claim 4, wherein the screwing plate portion and the wire connection portion are perpendicular relative to each other in their respective directions of elongation.

6. The connector according to claim 1, wherein the terminal escape space extends along a majority of the distance separating the front face of the connector housing and the wire connection portion.

7. The connector according to claim 1, wherein the electric wire extends orthogonally relative to the screwing plate portion.

8. The connector according to claim 7, wherein the electric wire extends perpendicular relative to the screwing plate portion.

9. The connector according to claim 1, wherein the screwing plate portion and the wire connection portion are unitarily formed and have substantially the same thickness.

* * * * *